United States Patent [19]

Boyd et al.

[11] Patent Number: 4,962,686

[45] Date of Patent: Oct. 16, 1990

[54] PERFORATING STRIP FOR PRINTING PRESSES

[76] Inventors: Harry Boyd, 500 Chautauqua, Norman, Okla. 73069; David Boyd, 8411 S. Toledo, Tulsa, Okla. 74137

[21] Appl. No.: 866,895

[22] Filed: May 27, 1986

[51] Int. Cl.[5] ..... B26D 1/22

[52] U.S. Cl. ..... 83/678; 83/332; 83/698; 101/226

[58] Field of Search ..... 83/678, 695, 663, 668, 83/667, 669, 670, 671, 672, 673, 674, 675, 346, 347, 665, 698; 76/107 C

[56] References Cited

U.S. PATENT DOCUMENTS

| | | | |
|---|---|---|---|
| 2,181,197 | 11/1939 | Moritz | 83/673 |
| 2,659,437 | 11/1953 | Huck | 83/346 X |
| 2,842,202 | 7/1958 | Boyd | 83/678 |
| 3,554,070 | 1/1971 | Boyd | 83/678 |
| 3,570,355 | 3/1971 | Spengler | 83/665 X |
| 3,792,637 | 2/1974 | Saunders | 83/673 |
| 4,391,175 | 7/1983 | Christain | 83/678 |

*Primary Examiner*—Frank T. Yost
*Assistant Examiner*—Scott A. Smith
*Attorney, Agent, or Firm*—Head and Johnson

[57] ABSTRACT

An improved perforating strip for use on printing presses formed of an elongated thin metal strip having a base portion of generally rectangular cross-section with flat upper and lower surfaces, the strip having integral upstanding teeth adjacent one edge, the edge of the strip opposite the teeth being curved from the lower surface to the upper surface providing a rounded edge which serves to substantially decrease the impression made in paper against which the strip is pressed, and in one embodiment the strip having an integral anchor portion downwardly extending from the edge opposite the teeth to penetrate the surface of a printing press impression cylinder.

2 Claims, 2 Drawing Sheets

PERFORATING STRIP FOR PRINTING PRESSES

SUMMARY OF THE INVENTION

A highly useful tool employed by the printing industry is a perforating strip which can be attached to the impression cylinders of offset or lithographic type presses. A perforating strip is a long, thin, flexible member with adhesive on the back so that an operator can place lengths of the perforating strip on printing press cylinders to form perforations in paper passing through the press. The perforations enable the user to tear the paper along the perforations, such as to tear out a coupon portion or an entire full width portion of the paper.

U.S. Pat. No. 3,147,658 teaches a basic perforating strip of the type to which the present invention relates. Improvements in this basic perforating strip are shown in U.S. Pat. No. 3,554,070 in which the teeth of the perforating strip are arranged in such a way as to have increased flexibility. These two prior issued patents are representative of the type of perforating strips being presently marketed.

The typical perforating strip includes a flat base portion with upper and lower surfaces. The lower surface receives an adhesive by which the strip is affixed to the impression cylinder of a printing press. One edge of the base includes integral upstanding teeth and the opposite edge is perpendicular the upper and lower surfaces. One problem with the existing perforating strips, as exemplified in these two prior issued patents, is that the base of the perforating strip leaves an impression or embossment in paper passing over it. While in some instances the impression is not a serious imperfection in the work being printed, in other instances it causes a noticeable reduction in the overall quality of the finished product.

The present invention provides a means of improving the overall quality of a finished, printed product by providing a perforating strip having the desirable features not found in the perforating strips presently used on the market today, as represented by these two previously issued patents, but in a manner wherein the outline of the base of the perforating strip is not embossed to a severe degree into the paper passing through a printing press.

In summary, one embodiment of the present invention provides a perforating strip which can be attached to impression cylinders of an offset or lithographic press for forming perforations in paper passing through the press. The device is in the form of an elongated, thin, metal strip having a base portion of generally rectangular cross-sectional configuration with a flat upper surface and a flat lower surface. The metal strip has integral upstanding teeth along one edge which extend generally perpendicular to the strip base portion. The edge of the base portion of the strip opposite the teeth is curved from the lower surface to the upper surface, the curve intersecting the upper surface asymptotically.

In another embodiment the perforating strip has the teeth centered on and extending upwardly from the base portion upper surface. Both opposed edges of the base portion are provided with a radius, or outside bevel, so that any imprint of the strip base portion on paper passing through a press equipped with a perforating strip is substantially reduced.

Another embodiment of the invention includes an arrangement for increasing the strength of the integrally formed teeth by providing a cross-sectional configuration of a perforating strip in which the inner, generally planar teeth surface merges with the base portion upper planar surface by an arcuate, inside beveled configuration. In this manner the base of the integrally formed teeth merge gradually with the strip base portion providing substantially increased strength of the support of the integrally formed teeth with the base to reduce the propensity of the teeth to break away from the base portion.

Another embodiment of the invention provides a perforating strip in which the base has an integral downwardly extending portion, sharp at the lower edge for slightly penetrating the impression cylinder of the printing press to which the strip is attached so as to more securely anchor the strip to the printing press.

In still another embodiment the invention provides a perforating strip in which the teeth are positioned entirely on the upper surface of the base adjacent to but spaced from one edge of the base. This arrangement gives the strip substantially increased strength compared to one in which the teeth are formed at one edge of the base, but at the same time allows the placement of strips on a printing press so as to form perforations which intersect each other at corners in which the perforations are not more distance from each other at the corners and at other areas of the perforation.

A better understanding of the invention will be had in the following description and claims, taken in conjunction with the attached drawings.

DETAILED DESCRIPTION OF THE PREFERRED EMBODIMENT

Figure 1:
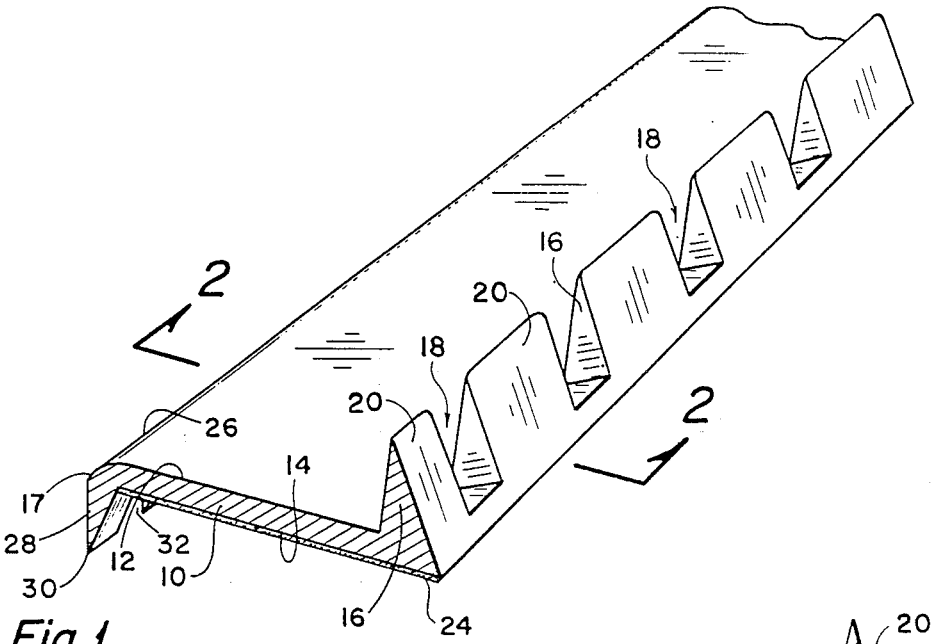
FIGS. 1–4 show preferred embodiments of the invention.

Referring to FIG. 1, a perforating strip embodying the principles of this invention is illustrated. The strip includes a base portion 10 having a flat upper surface 12 and a paralleled flat lower surface 14. The strip is elongated and is usually manufactured and sold in relatively long lengths of several feet. The user can cut the strip into lengths using tin-snips or strong scissors and attach the perforating strip to the printing press in whatever length is desired.

One edge of the base 10 includes teeth 16. The teeth are in a horizontal row and are typically arranged with separations 18 between them. The teeth are generally perpendicular to base 10. The opposite edge 17 of the base is parallel teeth 16.

To describe the teeth 16 more specifically, in cross-section they are formed by an outer planar surface 20 which intersects the base lower surface 14 at an obtuse angle. The teeth are further defined by an inner planar surface 22 which intersects the base upper surface 12 also at a right angle, the surfaces 20 and 22 intersecting each other at a sharp, acute angle.

A layer of adhesive 24 is applied to the lower surface 14 by means of which the strip is affixed to the impression cylinder of a printing press.

Figure 2:
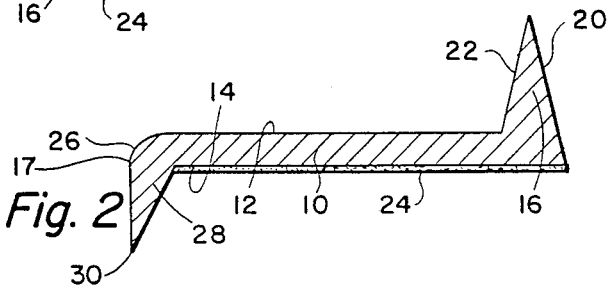
Figure 3:
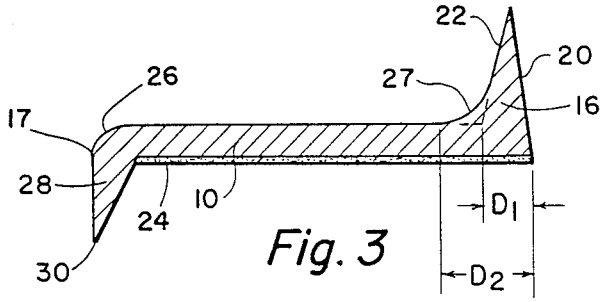

The structure described up to this point is more or less typical of perforating strip marketed today and as revealed in U.S. Pat. Nos. 2,842,202 and 3,554,070. One of the problems with such strips is that the strip base 10 is embossed into the paper which passes through a printing press having the perforating strip. This embossing is pronounced at the edge 11 of the base opposite that having the teeth 16. To overcome this problem we have discovered that the embossed effect impressed in paper can be significantly diminished if the edge 17 of the base 10 opposite the teeth 16 has an arcuate upper configuration as illustrated in FIGS. 1, 2 and 3. This arcuate edge 26 curves from the base lower surface 14 to intercept the base upper surface 12 asymptotically. In this way no sharp, defined edge surface is exposed to impress into paper passing through a press having the perforating strip. The provision of the arcuate edge 26 substantially increases the asthetic quality of the printing work done employing perforating strips by eliminating the embossed outline which is otherwise typically impressed in the paper passing through the press having the perforating strips.

Figure 4:
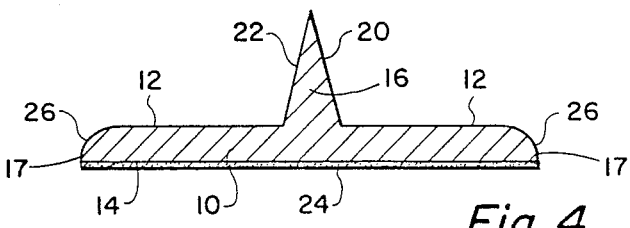

FIG. 4 shows an alternate arrangement of a perforating strip in which the teeth 16 extend upwardly from a centered position on the base portion top surface 12. In this embodiment the invention provides arcuate upper edges 26 along each opposed edge 17 of the strip base portion 10.

FIG. 3 shows an alternate embodiment having further advantages over the known type of perforating strips. One problem experienced with perforating strips is that the pressure applied by paper being forced against the perforating strip is substantially greater in the area of teeth 16. For this reason, and since the strip base 10 must be of relatively thin material, the teeth tend to break away from the base. This problem is more severe when the perforating strips are used on high speed printing presses. When the teeth break away from the base then obviously the perforating strip no longer functions and the printing operation must cease until a new perforating strip is installed on the press impression cylinder. FIG. 3 shows an embodiment wherein the tendency of the teeth to break away from the base is substantially reduced. FIG. 3 shows the inner planar surface 22 of teeth 16 projected to the point where it would normally contact the upper surface 12 of the base 10. In the arrangement of FIG. 3 the base and teeth are integrally formed to provide an arcuate inner bevel 27 so that the base of the teeth 16 gradually widen into the base portion 10 of the strip.

FIG. 3 shows the teeth inner surface 22 projected directly to the base upper surface 12 as reflected by the dotted line extension of the teeth inner surface 22. This projected extension of the teeth intersect the base at a length of D1. In the arrangement of FIG. 3 wherein the inner arcuate bevel 27 is employed the teeth 16 integrally merge with the base for a total distance of D2. The distance D2 must be at least 1.5 times D1 and is preferably about 2 times D1.

This arrangement of the cross-sectional configuration of the perforating strip wherein the teeth merge with the base in a way so that the ultimate base of the teeth is about twice the width of the base which is attained by the normal projection of the teeth planar surfaces as in FIG. 2 has been found to substantially eliminate the possibility of the teeth braking from the base even when the perforating strip is used on high speed printing presses.

FIGS. 1 through 3 show a further improvement of the invention. One of the problems in the use of perforating strips is that of securely anchoring the strips to the impression cylinder. This is achieved, as previously indicated, by the use of adhesive 24 placed on the bottom edge 14 of the base. While this arrangement serves generally satisfactorily, nevertheless, shifting of the perforating strips on the impression cylinder is a problem constantly placed by printers. To more securely anchor the perforating strip to the base, the embodiment of FIGS. 1 through 3 includes an integral anchoring portion 28 downwardly extends from edge 17. This anchoring portion has lower, sharp edge 30 which penetrates into the impression cylinder of the printing press slightly in an amount so as not to deteriorate the quality of the impression cylinder surface, but sufficiently to stabilize and anchor the perforating strip on the press. The integral anchoring portion 28 is preferably provided with spaces 32 between short lengths so as to increase flexibility of the strip. Thus, the anchoring portion 28 are shaped somewhat like the upwardly extending teeth 16 except the anchoring portions are of much shorter length.

Figure 5:
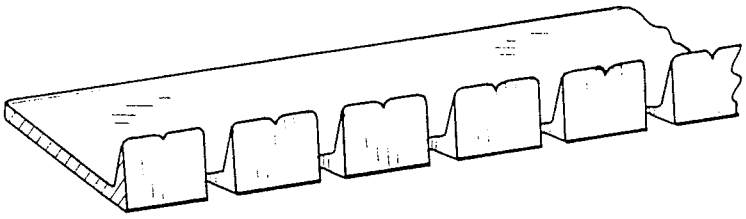
Fig. 5 (PRIOR ART)
FIG. 5 is an fragmentary, isometric view of a perforating strip as presently manufactured and sold indicating the state of prior art.
Figure 6:
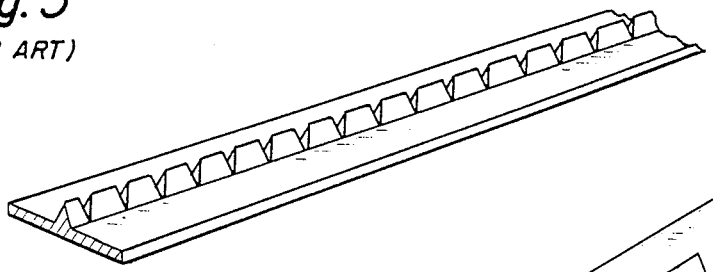
Fig. 6 (PRIOR ART)
FIG. 6 is another example of a perforating strip presently being manufactured and sold and also indicating the state of prior art.
Figure 7:
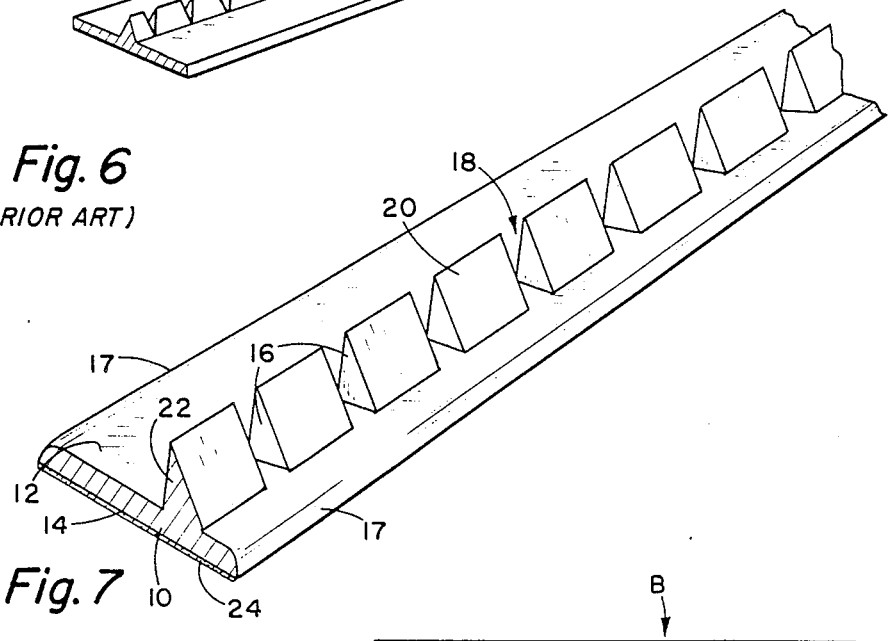
FIG. 7 is a fragmentary, isometric view of an improved perforating strip having features and advantages not available on performating strips of the prior art.
Figure 8:
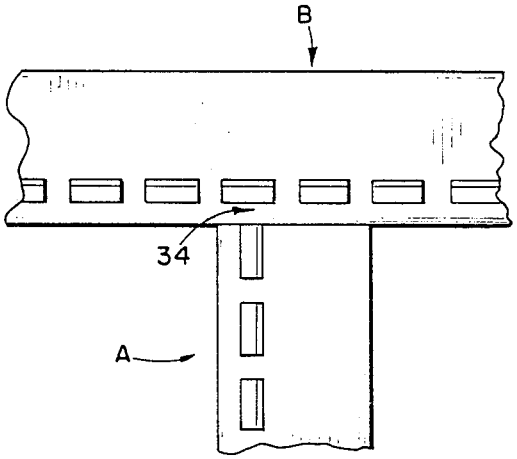
FIG. 8 is a planned view showing two perforating strips of the embodiment of FIG. 7 positioned on a printing press impression cylinder and arranged so that perforations formed in paper passing over the cylinder at an intersection of the perforations are of uniform spacing between the perforations at the intersection.

FIGS. 5 through 8 show another embodiment of the improved perforating strip of this invention. FIG. 5 shows a perforating strip of the prior art such as exemplified by U.S. Pat. No. 3,554,070 and FIG. 6 illustrates the prior art as exemplified by U.S. Pat. No. 2,842,202. These devices have functioned very successfully and have been commercially successful although they are not without some problems. The primary problem with the strip of FIG. 6 is that it is difficult to make angular intersections of perforations since the teeth, being positioned in the middle of the base, do not permit perforations closer together than the spacing between the teeth and the edge of the base. The embodiment of FIG. 5 permits spacing perforations at intersections as close together as possible, however, the embodiment of FIG. 5 has the problem that the teeth, being on the edge of the strip, tend more easily to break off the base. Thus, the embodiment of FIG. 6 is stronger, though more difficult to manufacture but does not permit close spacing of perforations at an intersection while the embodiment of FIG. 1 which does permit close spacing is not as long lasting. The embodiment of the invention illustrated in FIGS. 7 and 8 is intended to overcome the problems with each of these prior art devices. In the isometric view of FIG. 7 it is seen that the teeth 16 are supported entirely on the upper surface 12 of the base 10 but are positioned closer to one edge 17 than the opposed edge 17. When the strip is positioned on an impression cylinder to perform a series of perforations which intersect with each other, the strips can be arranged as in FIG. 8 so that the teeth form perforations in a way so that the spacing 34 between the teeth of strip A and those of strip B are not substantially greater than the spacings between perforations formed adjacent teeth.

It can be seen that the embodiment of FIG. 7 and 8 includes the advantages of the prior art combined in a unique way to achieve a perforating strip having applications for forming intersecting perforations of superior quality.

The invention set forth herein provides improved configurations for a perforating strip for use on printing presses and particularly provides a perforating strip producing a more asthetically acceptable job and wherein the failure of the strip as a consequence of repeated use is diminished.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A device which can be affixed to the impression cylinder of an offset or lithographic press or the like for forming perforations in paper passing through the press comprising an elongated, thin, metal strip having a base portion of generally rectangular cross-section with a flat upper surface and a flat lower surface and opposed first and second edges, the metal strip having integral teeth extending substantially perpendicular to the strip base portion upper surface along said first edge and said second edge of the base portion of the strip being curved from the lower surface to the upper surface providing a rounded outside radius edge which serves to substantially decrease the impression made in paper against which the strip is pressed, an integral pointed anchor downwardly extending from said base portion lower surface at said second edge and including adhesive applied to the base portion lower surface by which the strip can be removably affixed to a printing press impression cylinder.

2. A perforating strip according to claim 1 in which said integrally pointed anchor is in the form of spaced apart anchor teeth.

* * * * *